US007850131B2

(12) United States Patent
Battistella

(10) Patent No.: US 7,850,131 B2
(45) Date of Patent: Dec. 14, 2010

(54) TELESCOPIC LIFTING COLUMN WITH A SAFETY DEVICE

(75) Inventor: Francesco Battistella, Via Nori (IT)

(73) Assignee: Sir Societa' Italiana Riduttori SRL, Valdagno (VI) (IT)

( * ) Notice: Subject to any disclaimer, the term of this patent is extended or adjusted under 35 U.S.C. 154(b) by 0 days.

(21) Appl. No.: 12/373,660

(22) PCT Filed: Jul. 10, 2007

(86) PCT No.: PCT/EP2007/057054

§ 371 (c)(1),
(2), (4) Date: Apr. 30, 2009

(87) PCT Pub. No.: WO2008/012201

PCT Pub. Date: Jan. 31, 2008

(65) Prior Publication Data

US 2009/0250585 A1 Oct. 8, 2009

(30) Foreign Application Priority Data

Jul. 25, 2006 (IT) ..... VI2006A0238

(51) Int. Cl.
*F16M 11/00* (2006.01)

(52) U.S. Cl. ..... 248/161; 248/404

(58) Field of Classification Search ..... 248/161, 248/162.1, 404, 157, 125.8, 354.1; 74/89.35
See application file for complete search history.

(56) References Cited

U.S. PATENT DOCUMENTS 4,552,403 A 11/1985 Yindra
4,635,492 A * 1/1987 Uebelhart ..... 74/89.35
2001/0013307 A1 8/2001 Stone
2005/0161648 A1 * 7/2005 Oudelaar ..... 254/93 R
2005/0236564 A1 * 10/2005 Keller et al. ..... 250/288
2006/0144179 A1 * 7/2006 Greilinger et al. ..... 74/89.23
2008/0099637 A1 * 5/2008 Pai ..... 248/157

FOREIGN PATENT DOCUMENTS

EP 0 555 198 A1 8/1993
WO WO 01/68507 A1 9/2001

OTHER PUBLICATIONS

International Search Report re application No. PCT/EP2007/057054, dated Nov. 8, 2007.
Written Opinion re application No. PCT/EP2007/057054, dated Nov. 8, 2007.

* cited by examiner

*Primary Examiner*—Ramon O Ramirez
(74) *Attorney, Agent, or Firm*—Husch Blackwell LLP Welsh Katz

(57) ABSTRACT

The invention is a telescopic column (1) comprising: two or more tubular members (2; 3) telescopically engaging one inside the other; a drive unit (6) contained inside the tubular members (2; 3); a cover (4) attached to the end of the inner tubular member (3); a supporting plate (8) attached to the outside of the cover (4); a tubular rod (5) associated with the drive unit (6), installed inside the tubular members (2; 3) with its end (5*a*) associated with the cover (4); means (7) for controlling the extension and withdrawal of the tubular members (2; 3). During the withdrawal of the tubular rod (5) inside the tubular members (2; 3), a safety device (9) operatively connected to the control means (7) stops the drive unit (6) if a counteracting element (C) obstructs the lowering of the supporting plate (8).

15 Claims, 6 Drawing Sheets

TELESCOPIC LIFTING COLUMN WITH A SAFETY DEVICE

The invention relates to an improved telescopic column for raising and lowering equipment and people.

A well-known common use of telescopic columns is to achieve the controlled raising and lowering of equipment and people.

In particular, telescopic columns are frequently and widely used in hospitals and clinics to raise and lower medical equipment or medical and nursing personnel during medical examinations, instrumental analyses and surgical procedures.

These telescopic columns comprise two or more tubular members coaxial with one another and telescopically engaged one inside the other, movable with respect to one another along a longitudinal axis they define by means of a drive unit installed inside them.

More precisely, the drive unit is inserted in the tubular member forming the base and is associated with a rod that passes longitudinally through the tubular members and has one end connected to the cover of the last one of said tubular members.

A supporting plate, to which a piece of equipment or a chair is permanently connected, is attached to the outside of the cover.

The equipment or person can be raised and lowered by an operator who uses a hand-held keyboard to control the drive unit that extends or withdraws the tubular members forming the telescopic column.

An acknowledged drawback of such telescopic columns lies in the lack of a safety device to stop the column's movement automatically and promptly in the event of opposition from an object accidentally coming within its range of action.

Said lack of a stoppage device becomes particularly hazardous when the telescopic column is used in the medical sector, when the plate supporting the equipment or chair being lowered could come into contact with accidentally interposed objects or, worse, with the body of a patient being treated.

Clearly, the particularly hazardous nature of said second event could cause severe lesions to the person involved.

The present invention aims to overcome said drawback by constructing a telescopic column complete with a safety device for its automatic stoppage in the event of contact with any foreign body interfering with its lowering action.

The aforesaid object is achieved by a telescopic column having the characteristics stated in the attached main claim, to which the reader is referred for the sake of brevity.

Other details of its characteristics are discussed in the corresponding dependent claims.

According to the preferred embodiment described below, the drive unit is of the type comprising an electric motor with threaded worm and screw for the displacement of the mobile rod.

In another embodiment of the invention, the drive unit may be of the hydraulic type and consequently comprise a linear actuator associated with the mobile rod.

The safety device is of the contact type, which stops the movement of the mobile rod during the lowering action whenever the supporting plate encounters an obstacle that generates a thrust exceeding a previously-established maximum threshold in the direction opposite the lowering direction. The telescopic column that is the subject of the invention advantageously improves the safety of the column in all those applications, and the medical sector in particular, in which equipment and people need to be moved using telescopic columns.

The objects and advantages of the invention are better explained in the description of a preferred embodiment of the invention provided below as a non-limiting example, with reference to the attached drawings, wherein.

Figure 4:
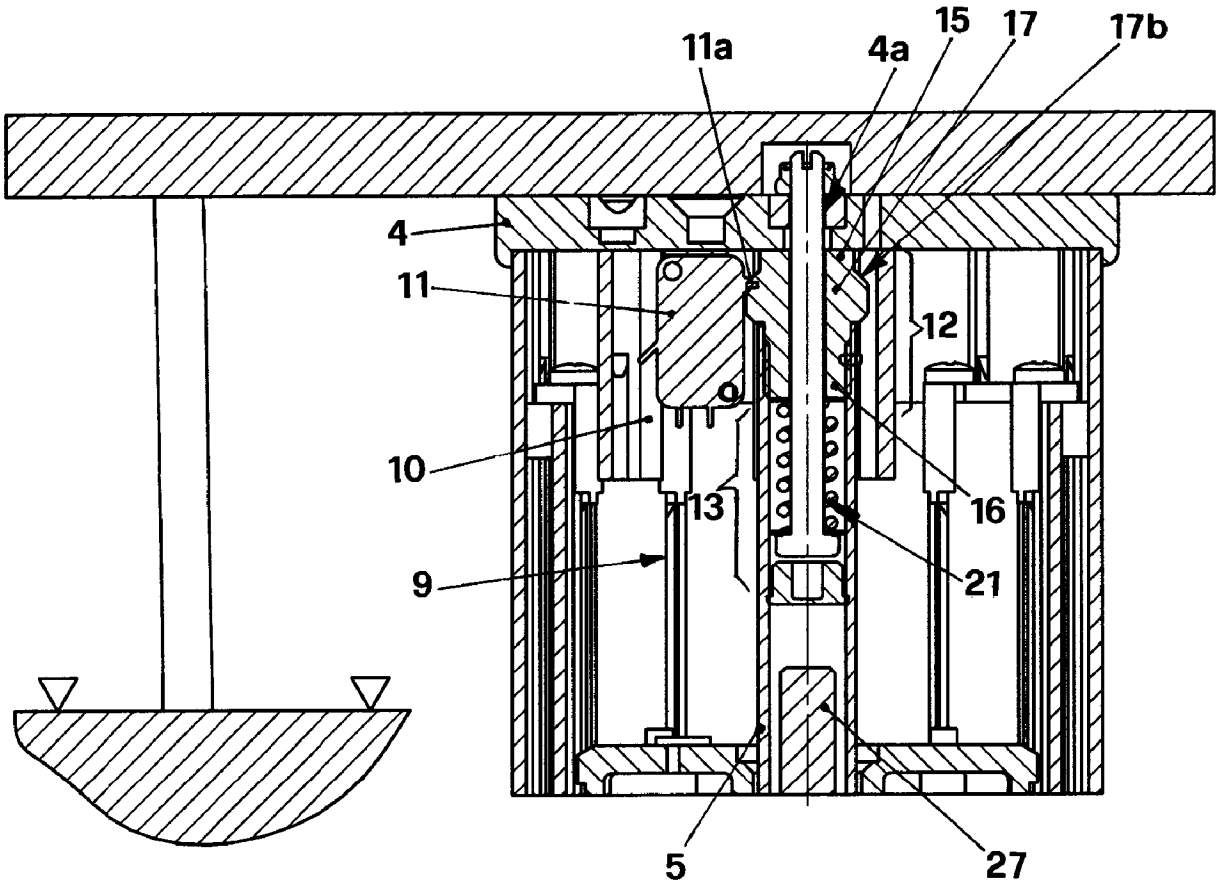
FIGS. 4 and 5 show a detail of FIG. 2 in two different operating conditions.
Figure 4A:
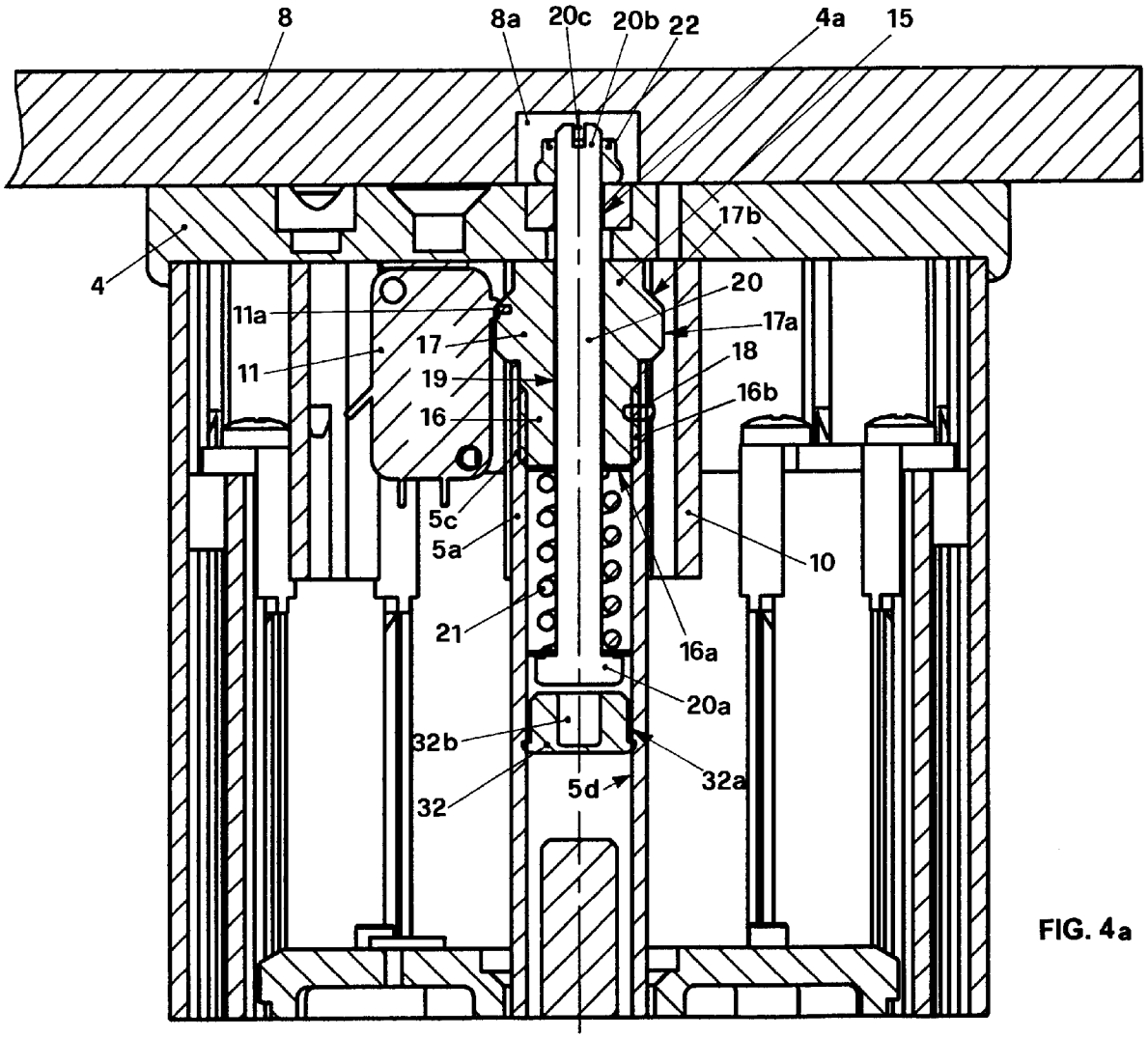

FIG. 4*a* shows an enlarged detail of FIG. 4.

Figure 1:
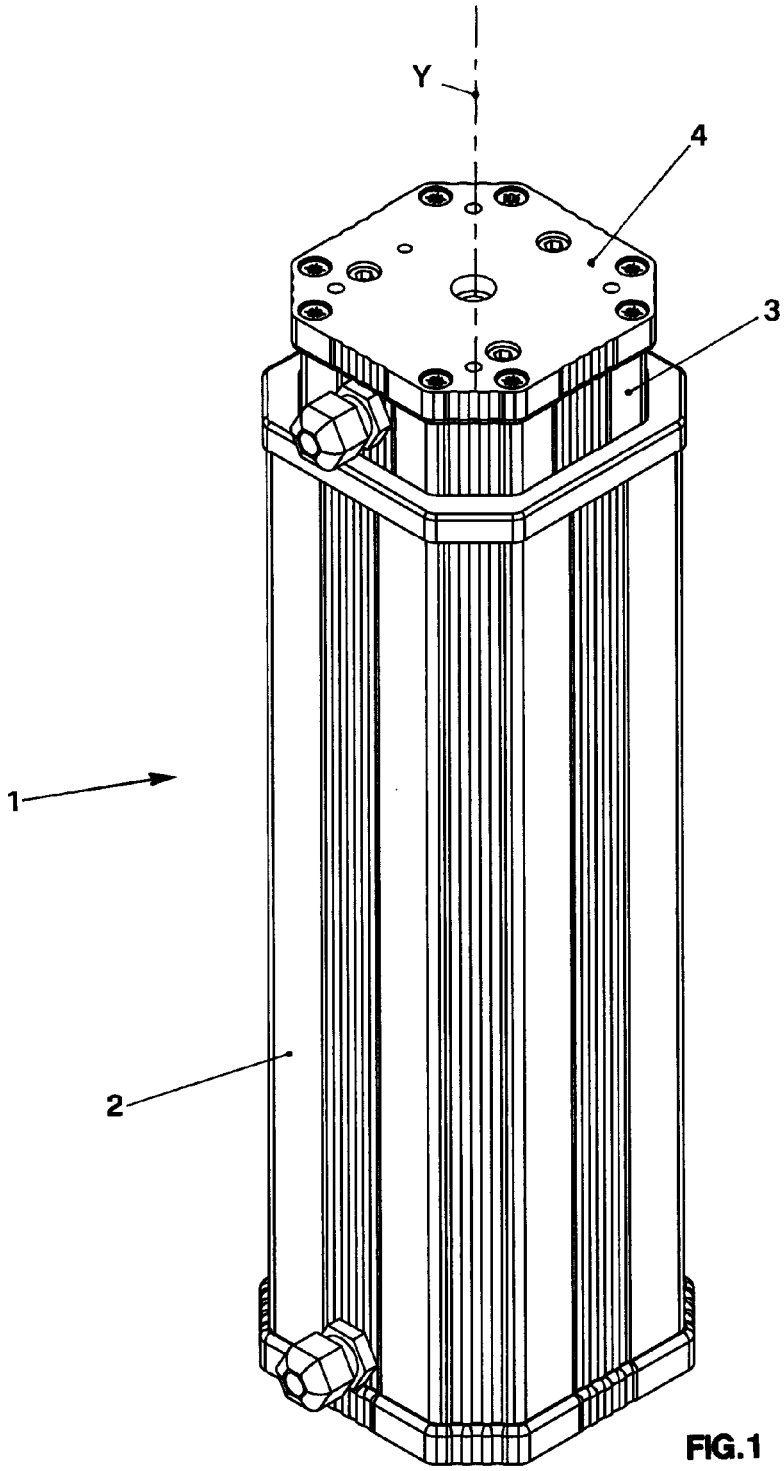
FIG. 1 shows an axonometric view of the telescopic column that is the subject of the invention.

The telescopic column that is the subject of the invention is represented in an axonometric view in FIG. 1, where it is indicated as a whole by the numeral 1.

The column consists of two tubular members 2, 3 coaxial with one another and telescopically engaged one inside the other, that define a longitudinal axis of displacement Y for the extension and withdrawal of the inner member 3 in relation to the outer member 2.

The embodiment described herein involves a telescopic column comprising two tubular members 2 and 3, but in other embodiments the telescopic column could clearly comprise more than two coaxial tubular members.

Figure 2:
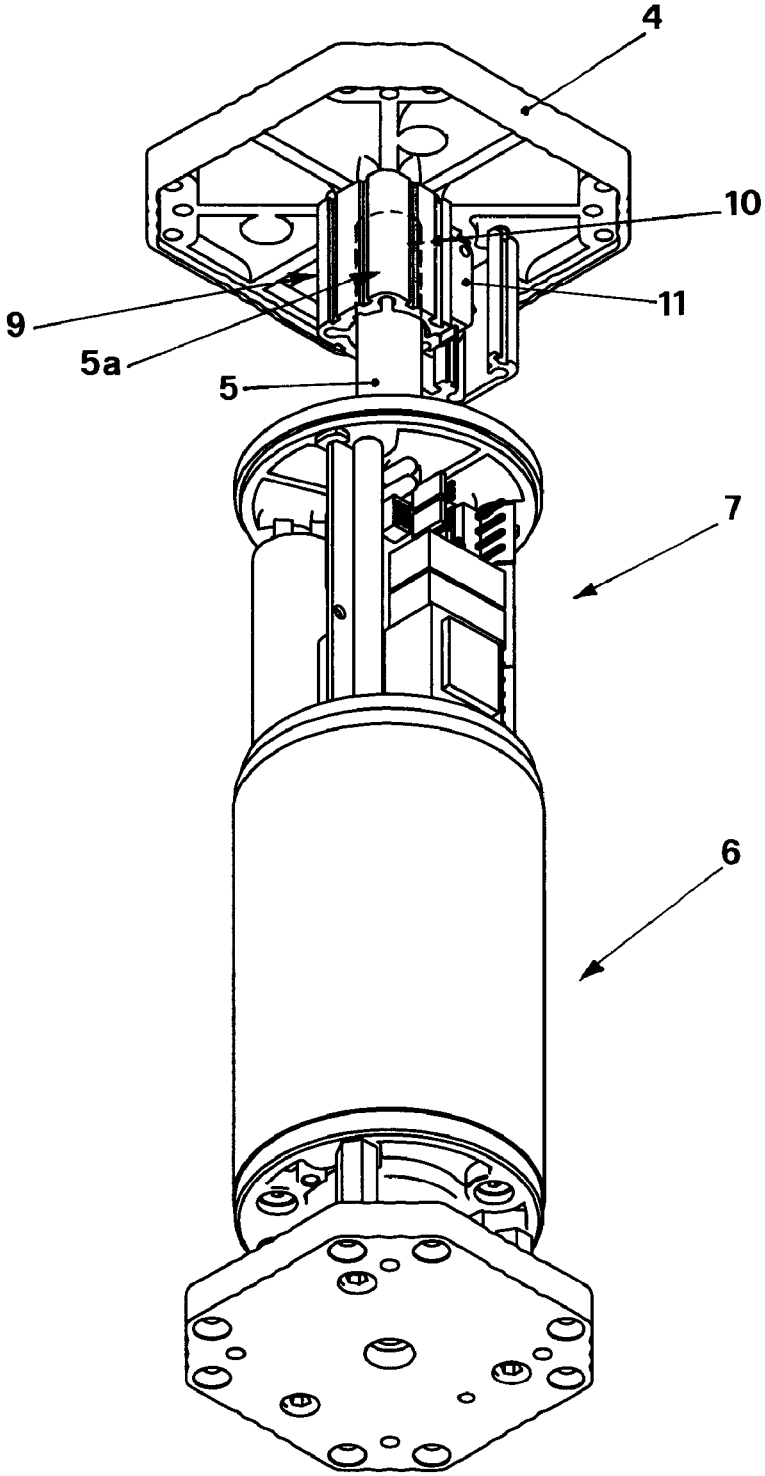
FIG. 2 shows a partial axonometric internal view of the column shown in FIG. 1.
Figure 3:
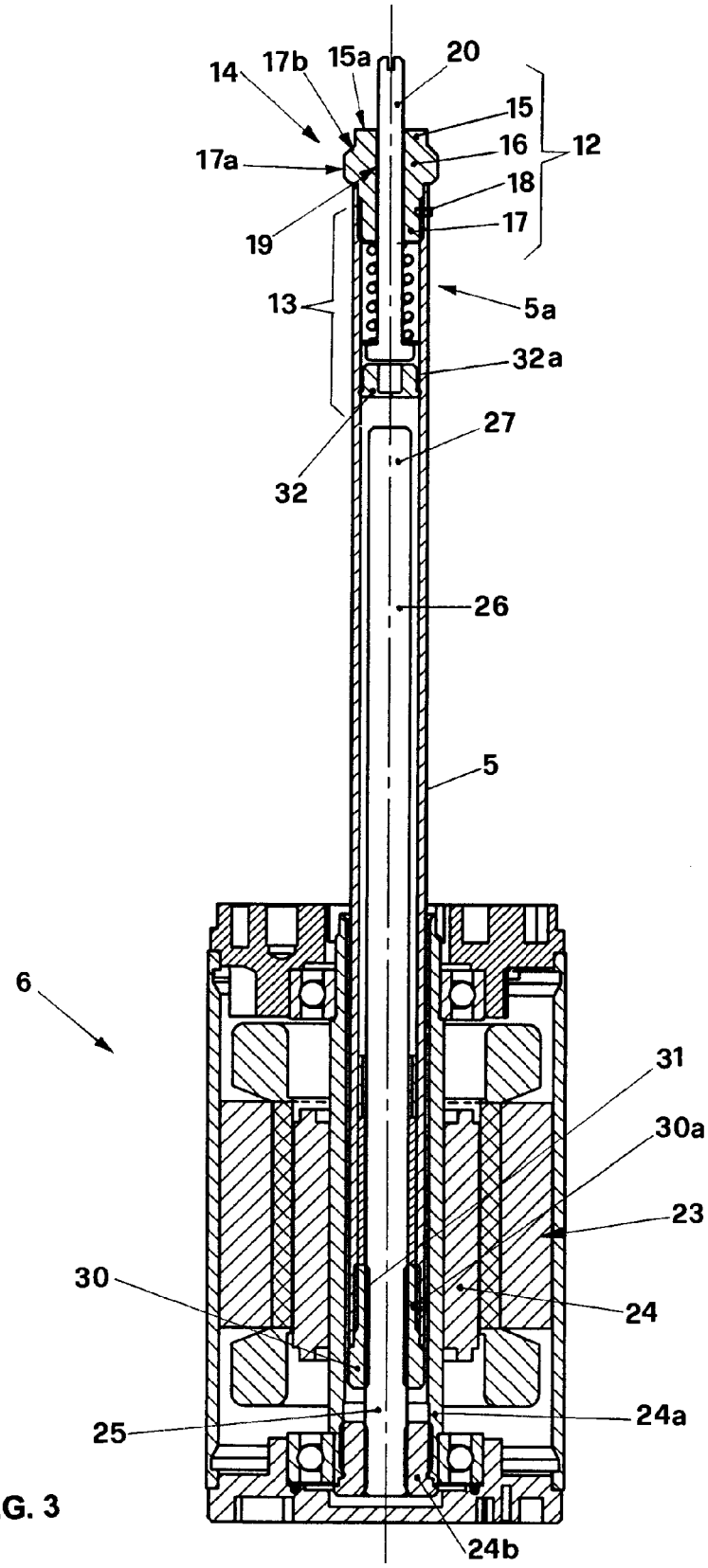
FIG. 3 shows a longitudinal cross-section of a detail of FIG. 2.

A cover 4 is attached to the upper end of the inner tubular member 3, as shown in greater detail in FIG. 2, and is associated with the end 5*a* of a tubular rod 5 that is positioned longitudinally inside the tubular members 2 and 3 and is associated with a drive unit 6 contained inside the tubular member 2, as shown in FIG. 3.

Again with reference to FIG. 2, the drive unit 6 is also associated with and operatively connected to means, indicated as a whole by the numeral 7, for controlling the displacement of the tubular rod 5 to enable the controlled extension or withdrawal of the inner tubular member 3.

Figure 5:
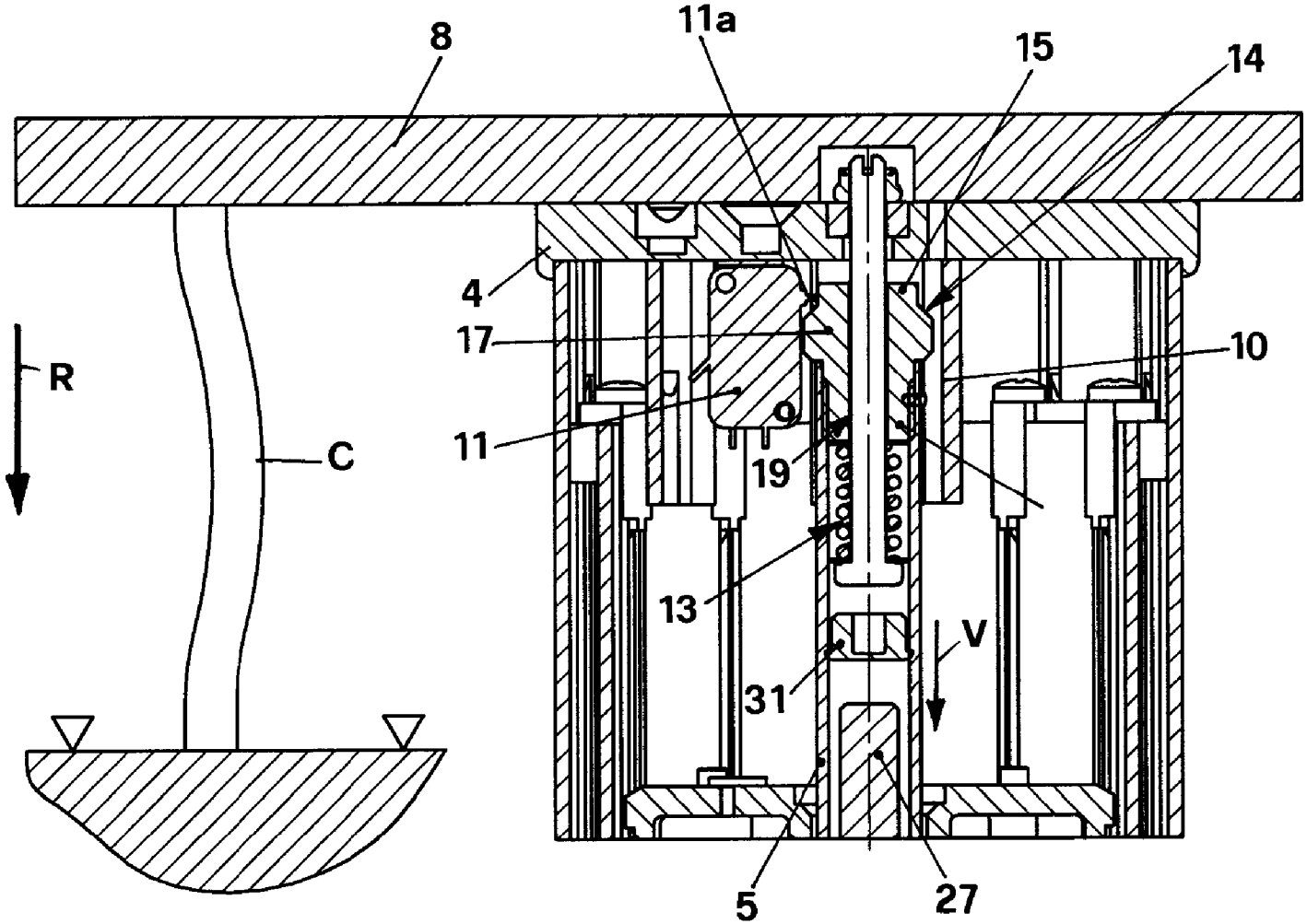

As shown in detail in FIGS. 4 and 5, a supporting plate 8 is attached to the outside of the cover 4 to provide support for any equipment or for a chair on which an operator can sit (neither of which is shown).

According to the invention, the telescopic column 1 comprises a safety device 9 operatively cooperating with the control means 7 to stop the drive unit 6 during the withdrawal of the tubular rod 5 inside the tubular members 2, 3 in the event of any counteracting elements C obstructing the lowering of the supporting plate 8.

In particular, with reference mainly to FIG. 4*a*, the safety device 9 comprises:

- a tubular sleeve 10 fixed to the cover 4 that slidingly contains the end 5*a* of the rod 5;
- a circuit breaker 11 mechanically connected to the tubular sleeve 10 and electrically connected to the means 7 for controlling the drive unit 6;
- means 12 for operating the circuit breaker 11 attached to the end 5*a* of the rod 5;
- an elastic assembly 13 interposed between the means 12 for operating the circuit breaker 11 and the cover 4.

The means 12 for operating the circuit breaker 11 comprise a shaped member 14 with a circular cross-section consisting of three zones, i.e.

- a first terminal zone 15 extending from the end 5*a* of the rod 5 and delimited by a first flat surface 15*a* facing towards the cover 4;
- a second terminal zone 16 coupled inside the end 5*a* of the tubular rod 5 and delimited by a second flat surface 16*a* facing towards the inside of said tubular rod;

a central zone 17 coming between the first 15 terminal zone and the second terminal 16, extending from the end 5*a* of the rod 5 to abut against the active member 11*a* of the circuit breaker 11.

The central zone 17 comprises a first ring-shaped band 17*a* with a cylindrical profile of larger diameter than the first terminal zone 15, and connected to the first terminal zone 15 by means of a second ring-shaped band 17*b* with a truncated cone-shaped profile.

During the displacement of the shaped member 14, the passage from the cylindrical profile 17*a* to the truncated cone-shaped profile 17*b* induces the tripping by contact of the active member 11*a* of the circuit breaker 11.

The shaped member 14 is attached to the first end 5*a* of the tubular rod 5 by means of a threaded coupling that comprises a male thread 16*b* obtained in the second terminal zone 16 and a female thread 5*c* obtained in the end 5*a* of the tubular rod 5.

To secure the coupling, a locking pin 18 is inserted crosswise in the second terminal zone 16 of the shaped member 14 and in the first end 5*a* of the tubular rod 5.

Finally, a through hole 19 involving the full length of the shaped member 14 enables its connection to the elastic assembly 13.

The elastic assembly 13 comprises:

a screw 20 inserted through the through hole 19 made in the shaped member 14, with its head 20*a* on the side of the second flat surface 16*a* of the second terminal zone 16 and its end 20*b* projecting from the first terminal zone 15 and positioned so as to pass through a hole 4*a* provided in the cover 4;

an elastic element, preferably but not necessarily consisting of a cylindrical spring 21, coming between the head 20*a* of the screw 20 and the second flat surface 16*a* of the second terminal zone 16 of the shaped member 14;

a nut 22 screwed onto the end 20*b* of the screw 20 so as to abut externally against the cover 4 to hold the two together.

The nut 22 is contained inside a seat 8*a* provided in the supporting plate 8 that is attached to the cover 4 with the aid of screws or other fixing means.

The end 20*b* of the screw 20 has a particular shaping 20*c* designed to contain a hand-operated manoeuvring tool. More precisely, the shaping 20*c* consists of a recess for containing the blade of a screwdriver.

The drive unit 6, shown in FIG. 3, comprises an electric motor 23 with its rotor 24 associated with the first end 25 of a threaded rod 26 by means of the interposition of a tubular member 24*a* and a bushing 24*b*.

The threaded rod 26 is inserted coaxially in the tubular rod 5 with its other end 27 free.

A sleeve 30 with an internal thread 31 suitable for coupling with the thread of the threaded rod 26 is attached to the tubular rod 5 by means of a pin 30*a*.

Thus, when the electric motor 23 is powered, the turning of its rotor 24 induces the rotation of the threaded rod 26, which causes the displacement of the sleeve 30 and the consequent raising or lowering of the tubular rod 5 with a resulting extraction or withdrawal of the inner tubular member 3 in relation to the outer tubular member 2.

Inside the tubular rod 5 there is an adjustable stop 32 provided with an external thread 32*a* that is coupled to the corresponding internal thread 5*d* of the tubular rod 5 and with a shaped element 32*b* for its adjustment that is accessible by means of a key through the end 5*a* of the rod 5.

Preferably, but not necessarily, the shaped element for adjusting the stop is a polygonal socket for containing a male polygonal wrench.

In operative terms, the assembly of the safety device 9 mainly entails screwing the adjustable stop 32 into the first end 5*a* of the tubular rod 5, using a manual wrench inserted in the shaped element to screw the stop 32 down and arrange it in the required position, as shown in FIG. 3.

Then the screw 20 comprising the elastic assembly 13 is inserted in the rod 5, with the head 20*a* of the screw 20 abutting against the adjustable stop 32 so that the end 20*b* of the screw 20 projects from the tubular rod 5 as shown again in FIG. 3.

Then the cylindrical spring 21 is installed coaxially on the outside of the screw 20 and the second terminal zone 16 of the shaped member 14 is screwed onto the end 5*a* of the tubular rod 5.

Finally, the shaped member 14 is attached to the end 5*a* of the tubular rod 5 by means of the crosswise locking pin 18.

The elastic force of the spring 21, and consequently the elastic force exerted by the elastic assembly 13, depends on the type of spring and consequently on its elastic constant and degree of precompression.

The end 5*a* of the tubular rod 5 is then slidingly engaged inside the tubular sleeve 10 and the nut 22 is used to fix the end 20*b* of the screw 20 of the elastic assembly 13 to the cover 4.

Finally, the circuit breaker 11 is attached to the tubular sleeve 10 and the supporting plate 8 is attached to the cover 4.

On completion of the assembly, the configuration is as shown in the detail of FIG. 4, showing the end of the telescopic column with the safety device 9 attached thereto in rest condition.

The circuit breaker 11 is normally closed, with the central zone 17 of the shaped member 14 lying in contact with the active member 11*a* of the circuit breaker, as shown in FIG. 4 and in FIG. 4*a*.

During the lowering of the supporting plate 8, when the tubular rod 5 is withdrawn inside the tubular members 2, 3 in the direction of the arrow R in FIG. 5, the safety device 9 is tripped if any counteracting element C juxtaposes against the underside of the supporting plate 8.

In fact, contact with the counteracting element C causes the lowering of the tubular rod 5 in the direction of the arrow V due to its first end 5*a* sliding inside the tubular sleeve 10, which induces the lowering of the shaped member 14.

The central zone 17 of the shaped member 14 thus leaves the active member 11*a* of the circuit breaker 11 free to return to the open position, with the consequent stoppage of the motor 23 of the drive unit 6.

The sliding of the end 5*a* of the tubular rod 5 also coincides with the compression of the spring 21, as shown in FIG. 5.

The elastic recovery of the spring 21 subsequently serves to restore the safety device 9 to its resting position and the circuit breaker 11 returns to the closed position shown in FIG. 5 when the counteracting element C is removed.

Based on the above description, it is clear that the telescopic column that is the subject of the invention achieves all the previously stated objects.

The safety device 9 intervenes when the force opposing the movement of the supporting plate 8 exceeds the elastic constant of the spring 21.

It has been demonstrated that an optimal setting value preferably corresponds to a strain of 20 kg.

In the executive stages, the telescopic column of the invention may undergo modifications and variants not described and illustrated herein.

For instance, instead of consisting of an electric motor, the drive unit could be a hydraulic unit comprising an air- or oil-powered linear actuator.

It goes without saying that such variants, like any others that may be made to the telescopic column of the invention, shall all be considered as being protected by the present patent, provided that they come within the scope of the claims that follow.

Where technical features mentioned in any claim are followed by reference signs, those reference sings have been included for the sole purpose of increasing the intelligibility of the claims and accordingly such reference signs do not have any limiting effect on the interpretation of each element identified by way of example by such reference signs.

The invention claimed is:

1. Telescopic column of the type comprising:

two or more tubular members coaxial with one another and telescopically engaged one inside the other, defining a longitudinal axis (Y) along which they may be extended or withdrawn;

a drive unit contained inside said tubular members;

a cover attached to the end of the inner tubular member and arranged in last place along said longitudinal axis (Y) and in the sense of the extension of the tubular members;

a supporting plate attached to the outside of said cover;

a tubular rod associated with said drive unit and positioned longitudinally inside said tubular members, its end being associated with said cover;

control means operatively connected to said drive unit for the controlled extension and withdrawal of said tubular members intended to achieve the raising and lowering of said supporting plate, said telescopic column comprising a safety device operatively connected to said control means so as to stop said drive unit during the withdrawal of said tubular rod inside said tubular members in the event of at least one counteracting elements (C) obstructing the lowering of said supporting plate, wherein said safety device comprises:

a tubular sleeve attached to said cover and slidingly containing said end of said rod;

at least one circuit breaker mechanically attached to said sleeve and electrically connected to said means for controlling said drive unit;

means for tripping said circuit breaker attached to said end of said rod;

at least one elastic assembly interposed between said means for tripping said circuit breaker and said cover.

2. Telescopic column according claim 1, wherein said means for tripping said circuit breaker comprise a shaped member with a circular cross-section in which it is possible to identify the following:

a first terminal zone extending from said end of said rod and delimited by a first flat surface facing towards said cover;

a second terminal zone coupled inside said end of said tubular rod and delimited by a second flat surface facing towards the inside of said tubular rod;

a central zone coming between said terminal zones and extending from said first end of said tubular rod to abut against the active member of said circuit breaker;

a through hole involving the full length of said shaped member for its connection to said elastic assembly.

3. Telescopic column according to claim 2, wherein said shaped member is attached to said end of said tubular rod by means of a threaded coupling that comprises a male thread obtained in said second terminal zone of said shaped member and a female thread obtained in said end of said tubular rod.

4. Telescopic column according to claim 2, wherein it comprises a locking pin inserted crosswise inside said second terminal zone of said shaped member and inside said end of said tubular rod.

5. Telescopic column according to claim 2, wherein said central zone comprises a first ring-shaped band with a cylindrical profile of larger diameter than said first terminal zone and connected to said first terminal zone by means of a second ring-shaped band with a truncated cone-shaped profile.

6. Telescopic column according to claim 1, wherein said elastic assembly comprises:

a screw inserted through said hole provided in said shaped member with its head on the side of said second flat surface of said second terminal zone engaging inside said end of said tubular rod and its end extending from said first flat surface of said first terminal zone through a hole provided in said cover;

an elastic element inserted between said head of said screw and said second flat surface;

a nut screwed onto said end of said screw and abutting externally against said cover.

7. Telescopic column according to claim 6, wherein said elastic element is a cylindrical spring positioned coaxially between said screw and said hole in which said screw is inserted.

8. Telescopic column according to claim 6, wherein said end of said screw has a shaping designed to contain a hand-operated manoeuvring tool.

9. Telescopic column according to claim 8, wherein said shaping for a hand-operated manoeuvring tool is a recess for containing the blade of a screwdriver.

10. Telescopic column according to claim 6, wherein it comprises an adjustable stop inserted in said end of said tubular rod and facing towards said head of said screw.

11. Telescopic column according to claim 10, wherein said adjustable stop has a shaped element for its adjustment that is accessible by means of a wrench through said end of said tubular rod.

12. Telescopic column according to claim 11, wherein said shaped element for adjusting the stop is a polygonal socket for inserting a male polygonal wrench.

13. Telescopic column according to claim 1, wherein said drive unit is contained inside the outer tubular member and is arranged first along said longitudinal axis (Y) and in the direction in which the tubular members are extendable.

14. Telescopic column according to claim 1 or claim 12, wherein said drive unit comprises:

an electric motor;

a threaded rod inserted coaxially inside said tubular rod with a first end associated with the rotor of said motor;

a sleeve with an internal thread engaging externally with said threaded rod and attached to said tubular rod.

15. Telescopic column according to claim 1, wherein said control means are contained inside said column and comprise an external keyboard for use by the operator.

* * * * *